United States Patent [19]

Begin

[11] Patent Number: 4,995,019

[45] Date of Patent: Feb. 19, 1991

[54] TIME PERIOD MEASURING APPARATUS WITH ADAPTIVE AVERAGING

[75] Inventor: John Begin, Troy, Mich.

[73] Assignee: MagneTek Controls, Clawson, Mich.

[21] Appl. No.: 534,187

[22] Filed: Jun. 6, 1990

[51] Int. Cl.[5] ..... G04F 8/00

[52] U.S. Cl. ..... 368/117; 368/120

[58] Field of Search ..... 368/113-120; 324/77 R, 78 R, 78 D, 79 R, 79 D; 377/20; 364/569

[56] References Cited

U.S. PATENT DOCUMENTS

| | | | |
|---|---|---|---|
| 3,637,733 | 1/1987 | Charles et al. | 368/120 |
| 4,516,861 | 5/1985 | Frew et al. | 368/120 |
| 4,603,292 | 7/1986 | Russeu | 368/120 |
| 4,845,691 | 7/1989 | Itaya et al. | 368/120 |
| 4,855,969 | 8/1989 | Mydill | 368/120 |
| 4,879,700 | 11/1989 | MacIntyre | 368/117 |

*Primary Examiner*—Vit W. Miska
*Attorney, Agent, or Firm*—Krass & Young

[57] ABSTRACT

An adaptive time period measurement technique which provides full speed for every measurement period with increased resolution afforded from repeated measurements. The time measure is produced by adaptively filtering a number of prior time measures. Each measurement includes a count and a fractional part from a controlled variable delay interposed in the measurement system. This variable delay is controlled over a number of measurements to cover the entire range of one clock cycle, preferably in accordance with a reversed binary progression algorithm. The adaptive filtering is preferably a self-modifying, classic low pass filter with a roll off which depends on the rate of change and direction of change of the measurerd time period. Thus the present invention provides all the resolution feasible based upon the rate of change of the measured quantity.

20 Claims, 4 Drawing Sheets

TIME PERIOD MEASURING APPARATUS WITH ADAPTIVE AVERAGING

FIELD OF THE INVENTION

The present invention relates to the field of time period measurement and more particularly to time period measurement employing adaptive averaging and a computer controlled delay for increased resolution.

BACKGROUND OF THE INVENTION

There are many measurement problems which ultimately can be reduced to a measurement of the time period between two events. Measurement of such parameters as linear or rotational velocity, linear or rotational acceleration, temperature, pressure, frequency, energy, power, current, voltage or position can be made using an accurate detection of a time period. Such time periods are often measured via a stable clock and counter. The accuracy and resolution of such time measurements thus depends upon the speed of the stable clock and the resolution of the counter. In such circuits the frequency of the clock generator is generally the limiting factor. Increased resolution of measurement generally requires clock generator circuits which operate at higher speeds and are more expensive, and higher speed counter circuits, at least for the highest speed stages, which are likewise more expensive.

In many applications the use of conventional clock and counter circuits yields less resolution than is desirable. It is known in the prior art to employ various cascading techniques to improve the resolution of such time measurements. This requires repeated measurements of the time period in question. The time periods are cascaded so that a number of such time periods are added together and the sum time measured using a clock and counter system. This technique is often called recirculation. Summing additional examples of the time period enables increased resolution by applying the time resolution capacity of the system over plural time periods. An increase in the time required to make the measurement is a natural consequence of this recirculation technique. This increase in time of measurement is a disadvantage, particularly when the measurement is employed in a feedback and control system. It is well known that delays in feedback and control systems contribute to instabilities. Thus the goals of increased resolution and decreased time of measurement are antagonistic.

A study of the nature of feedback and control loop design indicates that great resolution and fast speed are not generally required simultaneously. Great measurement speed is required during times when the measured quantity is changing moderately or rapidly. During times when the measured quantitY is changing most feedback and control systems exhibit significant errors in measurement. Great resolution is not required during such times because this resolution would be outweighed by inherent errors in the measurement process. However, during periods of motion speed of measurement is essential to reduce control instabilities inherent in delays. Conversely, great resolution is typically required only when the measured quantity is unchanging or nearly unchanging. During such times greater delays in the measurement process can be tolerated without introducing control instability. Under unchanging conditions the need for speed is reduced while the need for resolution is increased.

Thus while great resolution and great speed cannot easily be achieved simultaneously, they are not needed simultaneously. During times when great speed is required, great resolution is typically not helpful. During times when great resolution is needed, slower measurements may be tolerated. Thus a measurement system which can provide great speed during times when the measured quantity is changing and great resolution when the measured quantity is unchanging or nearly unchanging would often be as useful as a system which provides great speed and great resolution simultaneously.

SUMMARY OF THE INVENTION

The present invention enables time period measurement at full speed for every measurement period with increased resolution afforded from repeated measurements. This is achieved by providing a measurement output which is the filtered algebraic sum of the raw count from the counter and the fractional part from a number of prior measurements. The fractional part is formed from a controlled variable delay interposed in the measurement system. The filtering is preferably provided by an adaptive averaging technique. This adaptive averaging technique is preferably a selfmodifying, classic low pass filter. The roll off of the filter depends on the rate of change of the measured time period. Thus the present invention provides all the resolution feasible based upon the velocity of the measured quantity.

The preferred embodiment of the present invention achieves this fractional part using a microcomputer controlled variable delay. This variable delay is adjustable over the range of one clock cycle. Thus each time period measure produces a count from the counter and an additional term which can vary over a fractional part of one count. This variable delay can be introduced into the measurement system in a number of ways. The triggering of the time period measure can be delayed relative to enabling the counter. The enabling of the counter can be delayed relative to the triggering of the time period to be measured. The disabling of the counter can be delayed relative to the end of the time period to be measured. In addition, the phase of the clock driving the counter may be altered while the counter is counting or the time period and the counting may be triggered at a variable phase of the clock signal. This variable delay is controlled over a number of measurements to cover the entire range of one clock cycle, preferably with a flat histogram. In accordance with the preferred embodiment of the present application, the selection of the time delay is in accordance with a reversed binary progression algorithm. Such a reversed binary progression algorithm enables the time period measure to settle to a stable value in the least amount of time over the entire range.

Brief Description of the Drawings

These and other objects and aspects of the present invention will become clear from the following description of the invention, in which.

Detailed Description of the Preferred Embodiment

Figure 1:
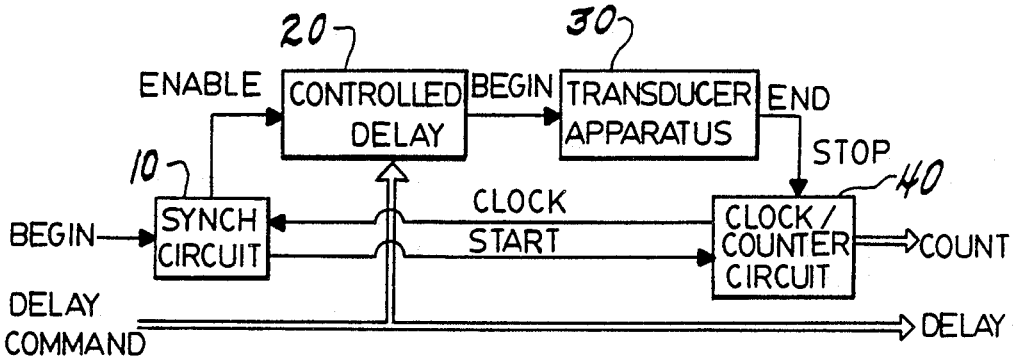
FIG. 1 is a general block diagram of the time period measuring apparatus of the present invention.

FIG. 1 illustrates the preferred embodiment of the present invention in general block diagram form. The time period measurement process is begun via a begin command transmitted to a synchronization circuit 10. Synchronization circuit 10 also receives the clock signals from clock/counter circuit 40. Synchronization circuit 10 is provided to insure that the measurement process is begun in synchronism with the clock of clock/counter circuit 40. Synchronization circuit 10 transmits an enable signal to controlled delay circuit 20 and transmits a start signal to clock/counter circuit 40 upon detection of the first clock pulse from clock/counter circuit 40 following receipt of the begin signal.

Controlled delay circuit 20 provides a predetermined controlled delay. This controlled delay is in accordance with a delay command received from a controller apparatus (not shown, see FIG. 2). The manner of control of this delay is further detailed below. After expiration of the predetermined controlled delay, controlled delay circuit 20 transmits a begin signal to transducer apparatus 30. Transducer apparatus 30 converts a physical quantity to be measured into a corresponding time period. After expiration of this corresponding time period, transducer apparatus 30 produces an end signal. As noted above, the time period between the receipt of the begin signal and the transmission of the end signal corresponds to some measured physical quantity such as position, speed, acceleration and the like.

Clock/counter circuit 40 is a conventional circuit for determining the time period of transducer apparatus 30. Clock/counter circuit 40 includes a clock generator which produces clock pulses at a predetermined rate and a counter which counts the number of such clock pulses received during a measurement interval. In the case of the apparatus illustrated in FIG. 1, the resultant count is an indication of the sum of the delay time of controlled delay circuit 20 and the time period of transducer apparatus 30. Thus the difference between the count of clock/counter circuit 40 and the delay of the delay command is a measure of the time period of transducer apparatus 30, and further a measure of the physical quantity to be measured.

It is known in the prior art to measure time periods using only a clock/counter circuit such as clock/counter circuit 40. Such an indication of the time period can only be resolved to within the period of one clock cycle. In particular, it is known that the time period of transducer apparatus 30 may include a fractional part of one clock cycle following the last clock pulse counted. Clock/counter circuit 40 cannot distinguish between the cases in which this fractional part is near zero and in which this fractional part is just less than one clock cycle. Thus the physical quantity measured by transducer apparatus 30 cannot be resolved finer that the amount corresponding to one clock cycle. The purpose of the present invention is to distinguish such between differing fractional parts.

The present invention varies the controlled delay and provides an averaged algebraic sum of the actual count and the amount of the controlled delay. This process requires a number of measures of the time period provided by transducer apparatus 30. The delay command is varied during these plural measures over a range of one clock cycle. This variation of the delay command is such that delays are evenly distributed over this range of one clock cycle. The resultant differences will include some cases in which the delay was not great enough to produce an additional count in clock/counter circuit 40 and other cases in which the delay was enough to produce such an additional count. These cases will be distributed in proportion to the fractional part of the time period of transducer apparatus 30. Thus the average difference over a sufficiently great number of samples will yield resolution finer than a clock cycle of clock/counter circuit 40.

Figure 2:
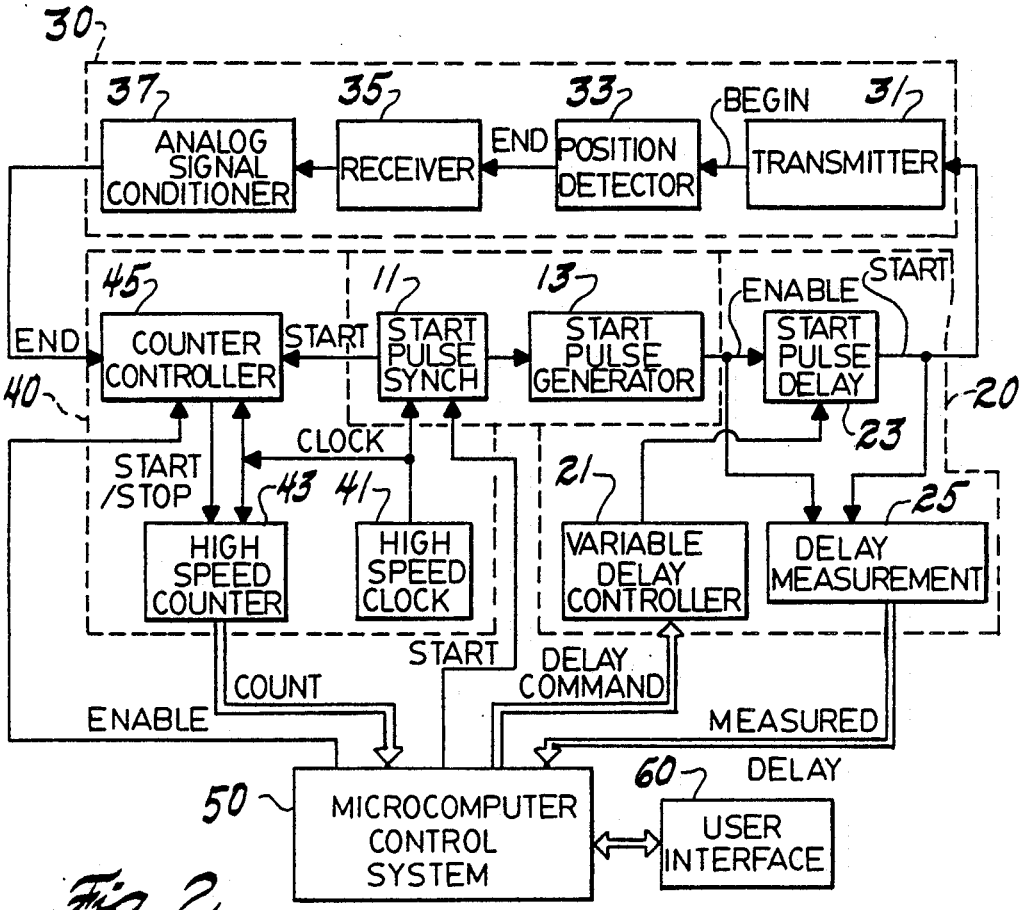
FIG. 2 is a more detailed block diagram of the preferred embodiment of the time period measuring apparatus illustrated in FIG. 1.

FIG. 2 illustrates in further detailed block diagram form the preferred embodiment of adaptive time period and computer controlled delay measuring system of the present invention. Synchronization circuit 10 includes: start pulse synchronizer 11; and start pulse generator 13. Controlled delay circuit 20 includes: variable delay controller 21; start pulse delay circuit 23; and delay measurement circuit 25. Transducer apparatus 30 includes: transmitter 31; magnetostrictive position detector 33; receiver 35; and analog signal conditioner 37. Clock/counter circuit 40 includes: high speed clock 41; high speed counter 43; and counter controller 45. The time period measuring apparatus also includes microcomputer control system 50 and user interface 60.

Figure 3:
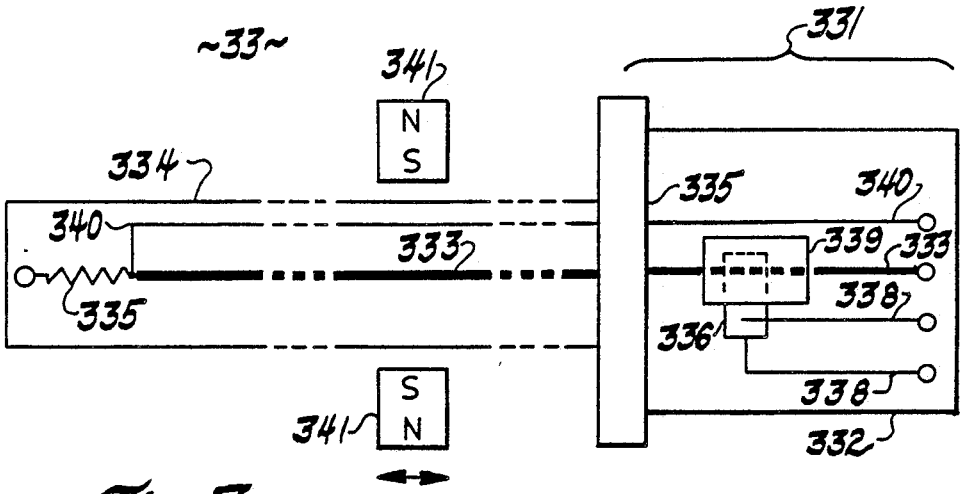
FIG. 3 is a cross sectional view of preferred embodiment of the variable time period transducer apparatus illustrated in FIG. 1.

FIG. 3 illustrates in simplified form details of the mechanical and electromechanical components of transducer apparatus 33. In accordance with the preferred embodiment of the present invention transducer apparatus 33 is a magnetostrictive position detector. Those skilled in the art would realize that this magnetostrictive position detector is just one example of many measurement devices which yield results as a varying time period. Head 331 includes steel base plate 332 which provides a structure for the mounting of a magnetostrictive wire 333. Magnetostrictive wire 333 is preferably formed of nickel/iron alloy; a material known as Nispan C is suitable. Magnetostrictive wire 333 runs straight through the center of tube 334 and is secured at the head end by solder to a terminal on an insulating pad (not shown) which is secured base plate 332. Magnetostrictive wire 333 extends through a hollow center of head 331 through the center of tube 334 along substantially the entire length thereof. At the foot end magnetostrictive wire 333 is secured by means of a tension spring 335 to the foot end of tube 334. Magnetostrictive wire 333 is held in spaced relationship relative to the interior walls of tube 334 by means of rubber spacers (not shown) which may occur at regular or irregular periods along the entire length of tube 334. There is essentially no limit on the length of tube 334; i.e., transducers of 40 feet in length are just as feasible as those of only a few feet in length. Spring 335 ensures proper tension in magnetostrictive wire 333 so that it runs straight and parallel through tube 334. Further details of the construction of a suitable magnetostrictive position detector 33 may be found in Koski et al, U.S. Pat. No. 4,839,590, which is assigned to the same assignee as this application.

A transducer 336 is provided in mechanical contact with magnetostrictive wire 333 near the head end. Transducer 336 may impart an acoustical/mechanical strain to magnetostrictive wire 333 upon receipt of an electrical command or may generate an electrical signal upon detection of an acoustical/mechanical strain. In the preferred embodiment, transducer 336 operates to detect acoustical/mechanical strain.

Transducer 336 comprises a first silicone rubber pad which rests on a surface of base plate 332 under magnetostrictive wire 333. A small rectangular piezoelectric crystal 337 rests on the first pad and provides a seat for magnetostrictive wire 333. Piezoelectric crystal 337 includes plating which allows signal wires 338 to be electrically connected to opposite faces. Magnetostrictive wire 333 rests on a portion of piezoelectric crystal 337 free of this plating. A second silicone rubber pad is placed on top of magnetostrictive wire 333 after it is seated on the exposed, non-conductive portion of piezoelectric crystal 337 and a metal clamp plate 339 is held in place by any suitable means to clamp magnetostrictive wire 333 down onto piezoelectric crystal 337.

Piezoelectric crystal 337 operates as a bidirectional transducer. When a propagating acoustical/mechanical strain arrives at transducer 336, the top face of piezoelectric crystal 337 is sheared relative to its bottom face. This induces a voltage across these faces which is sensed by signal wires 338 attached to the opposite faces. Conversely, when a voltage is applied across the faces by means of signal wires 338, piezoelectric crystal 337 expands longitudinally; i.e., in the direction which is transverse to magnetostrictive wire 333. In combination with the clamp effect produced by the first and second pads, base plate 332 and clamp plate 339, the expansion of piezoelectric crystal 337 acts like a rack and pinion arrangement to roll magnetostrictive wire 333 and impart a localized acoustical/mechanical strain. This acoustical/mechanical strain thereafter propagates along magnetostrictive wire 333 from the head end toward the foot end.

The foot end of magnetostrictive wire 333 is electrically connected to a fine copper signal return wire 340 which passes in parallel spaced relationship to magnetostrictive wire 333 and through tube 334. Magnetostrictive wire 333 and signal return wire 340 form a series circuit connected to electronics for producing an electronic pulse or for detecting such an electronic pulse.

Finally, a circular magnet 341 having radially arranged north and south poles is slidably disposed around tube 334 so that it may move along the length of tube 334 over the measurement range. Magnet 341 may be contained within a fluid tight float in the case of a liquid level detector. Alternatively magnet 341 may be attached to a machine tool or other mechanical components whose position over a predetermined range is to be monitored.

Magnetostrictive position detector 33 can operate in either of two modes. In the preferred mode, the transmitter 31 produces an electrical pulse which is applied. to the series combination of magnetostrictive wire 333 and return wire 340. This electrical pulse preferably has a relatively short duration of approximately 5 microseconds. When this electrical signal reaches the position of magnet 341, a localized accoustical/mechanical strain is imparted to magnetostrictive wire 333 by the interaction of this electrical pulse and the magnetic field of magnet 341. This localized acoustical/mechanical strain propagates along magnetostrictive wire 333 toward both the head and the foot ends at a known rate. A typical propagation rate is about 9.3 microseconds per inch. The acoustical/mechanical strain propagating toward the foot end is absorbed in the foot termination of magnetostrictive wire 333. The acoustical/mechanical strain propagating toward the head end is detected by transducer 336. Transducer 336 signals receiver 35 when this detection takes place. The length of time between the production of the electrical pulse and the reception of the return acoustical/mechanical strain is a function of the position of magnet 341. The position of magnet 341, in turn, represents a liquid level or other monitored quantity. The magnetostrictive position detector 33 can also operate in the converse situation. In this case, transducer 336 when triggered by transmitter 31 imparts a localized acoustical/mechanical strain to magnetostrictive wire 333 in a manner previously described. This localized acoustical/mechanical strain propagates along magnetostrictive wire 333 toward the foot end at the known rate. As the acoustical/mechanical disturbance passes through the area of influence of magnet 341, it induces a voltage having the wave form of a damped sine wave in magnetostrictive wire 333. This voltage travels at near the speed of light through magnetostrictive wiree 333 and through signal return wire 340 to an electric sensor circuit which signals receiver 35. The period between the production of the acoustical/mechanical strain and the detection of the electrical pulse is employed in the same manner as described above.

The impartation of an electrical pulse with detection of induced acoustical/mechanical strain is preferred for two reasons. Firstly, the application of electrical signals to magnetostrictive wiree 333 tends to create a more uniform magnetic field throughout the length of magnetostrictive wire 333. This electrical pulse thus serves to limit any differences in residual magnetism. Otherwise, magnet 341 may induce some residual magnetism in a part of magnetostrictive wire 333. This residual magnetism may cause hysteresis errors if magnet 341 is moving, particularly when magnet 341 reverses its direction. Secondly, the preferred operation reduces electrical noise in the detection. Coupling an electrical detector to magnetostrictive wire 333 results in a considerable effective antenna which can receive induced voltages. On the other hand, a acoustical/mechanical strain detector is relatively small and can be easily shielded from induced voltages.

Figure 4:
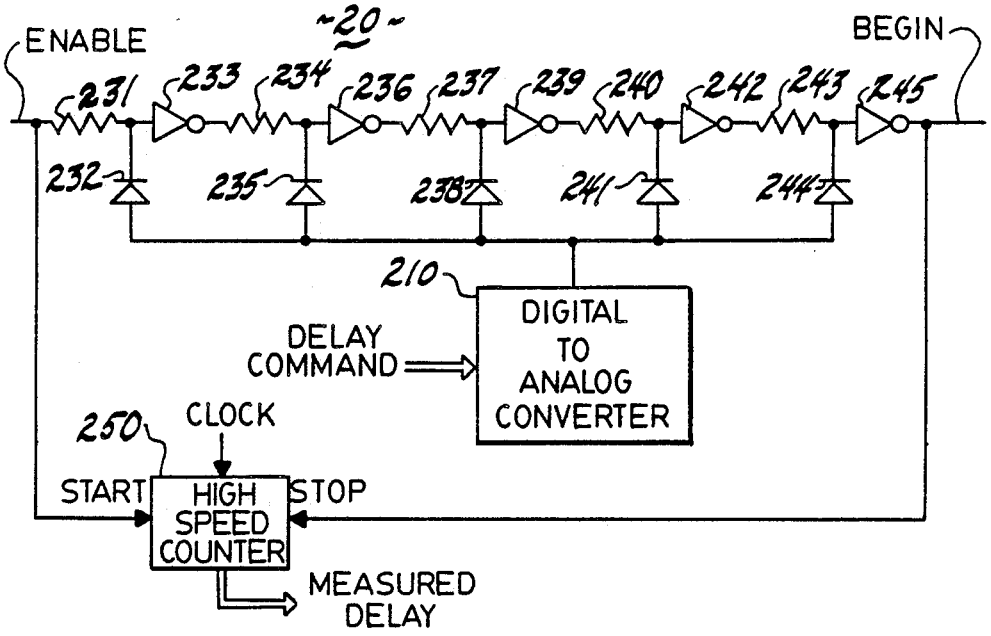
FIG. 4 is a detailed block diagram of the preferred embodiment of the controlled delay illustrated in FIG. 1.

FIG. 4 illustrates in further detail the manner of construction of controlled delay 20. In the preferred embodiment controlled delay 20 is achieved via a multistage voltage controlled RC delay line. FIG. 4 illustrates five RC delay stages, each including a series resistor (231, 234, 237, 240 and 243), a varactor diode (232, 235, 238, 241 and 244) and an invertor (233, 236, 239, 242 and 245). Each varactor diode 232, 235, 238, 241 and 244 is back biased by the output of digital to analog converter 210 so that they act like capacitors, thus forming corresponding RC circuits. In this embodiment five invertor stages are employed to produce overall phase inversion in the delay line. If inversion is not desired in this delay, than an even number of stages or an additional invertor can be employed.

The input to each invertor includes an RC time constant circuit consisting a fixed resistor and a varactor diode. Consider that first stage including resistor 231, varactor diode 232 and invertor 233. In the preferred embodiment the enable signal is the positive going edge of a +5 volt logic pulse. This pulse is produced at such a low duty cycle that varactor diode 232 is fully discharged on receipt of this leading edge. Thus upon receipt of the leading edge of the enable signal, the voltage at the input of invertor 233 rises slowly due to the need to charge the capacitance of varactor diode 232. Invertor 233 is not triggered until the voltage across varactor diode 232 at the input node reaches the voltage trigger threshold of invertor 233. Thus invetor 233 produces a signal that is time delayed from the receipt of the leading edge of the enable signal. Because the rate of rise of the voltage is proportional to the capacitance of varactor diode 232, and because the effective capacitance of varactor diode 232 is controlled by the bias voltage from digital to analog converter 210, the delay of this stage is controllable. The five stages include identical components producing like delays which are cascaded to dalay the production of the begin signal a controllable amount after receipt of the enable signal.

The capacitance of each varactor diode 232, 235, 238, 241 and 244 and thus the delay of controlled delay 20 is controlled by digital to analog converter 210. In the preferred embodiment digital to analog converter 210 receives a 12 bit delay command from microcomputer controller system 50. This delay command is converted into an analog voltage in the range of 0 vbolts to −10 volts. This analog voltage is applied to the anode of each varactor diode 232, 235,238, 241 and 244 providing control of their respective capacitances. Control of the capacitances of varactor diodes 232, 235,238, 241 and 244 controls the RC time constant of each stage, thereby controlling the total delay.

This variable delay technique would be usable without further control circuitry, except that the delay produced by this technique tends to drift. This drift is caused by shifts in the voltage/capacitance curve of the varactor diodes 232, 235,238, 241 and 244 and in the voltage trigger thresholds of invertors 233, 236, 239, 242 and 245 with temperature. it has been found that with current technology the delay produced by this circuit is insufficiently stable without additional control circuitry. It is necessary to control the delay command to compensate for such drift.

Compensation of the delay command requires some measure of the delay produced by the delay circuit. Such a measure is difficult to produce because the delay to be measured is controlled in time to intervals less than the fastest clock frequency available in the circuit. The preferred embodiment of the present invention employs measurement of only the end points of the delay range using this clock frequency. The chain of five delay stages is selected to have to have a total delay controllable via the analog output voltage of digital to analog converter over the range of several clock cycles, typically 5 to 8 clock cycles. After calibration, the delay command is controlled to produce delays over a single clock cycle within the middle of this range, for example, from 6 to 7 clock cycles. Such a middle range is selected to permit periodic recalibration of the end points of this range to compensate for drift while retaining the capability of variation over an entire clock cycle.

Calibration of the delay command takes place as follows. High speed counter 250 is coupled to be start counting upon receipt of the leading edge of the enable signal and to stop counting upon receipt of the leading edge of the begin signal. High speed counter 250 receives clock pulses from high speed clock 41, the same clock which operates high speed counter 43 for the basic measurement. In the preferred embodiment high speed counter 250 is identical to the initial 8 bits of high speed counter 43 and consists of an Advanced CMOS TTL compatible counter. Naturally the count of high speed counter 250 cannot resolve the delay time any finer than the clock cycle of high speed clock 41. It is necessary to determine the number within the range from 0 to 4096 (12 bits) of the delay command which produces a delay of N clock cycles. This first delay command $C_n$ is selected as the delay command which causes the count of high speed counter 250 to be N−1 approximately 50% of the time and N approximately 50% of the time. This delay command $C_n$ corresponds to the best approximation of a fractional dely of 0.001 of a clock cycle. This approximation is feasible because of small variations in the actual delay produced for the identical delay command. Next the second delay command $C_{n+1}$ is determined as the delay command which causes the count of high speed counter 250 to be N approximately 50% of the time and N+1 approximately 50% of the time. This delay command $C_n$ corresponds to the best approximation of a fractional delay of 0.999 of a clock cycle. Other fractional delays are achieved by linear interpolation between the counts $C_n$ and $C_{n+1}$. These end points are periodically recalibrated during operation of the time period measuring apparatus to account for drift in the relationship between the delay command and the actual delay produced. It is believed that this relationship drifts sufficiently slowly that the calibration of only the end points of the delay range is sufficient for accurate time period measurement.

Figure 5:
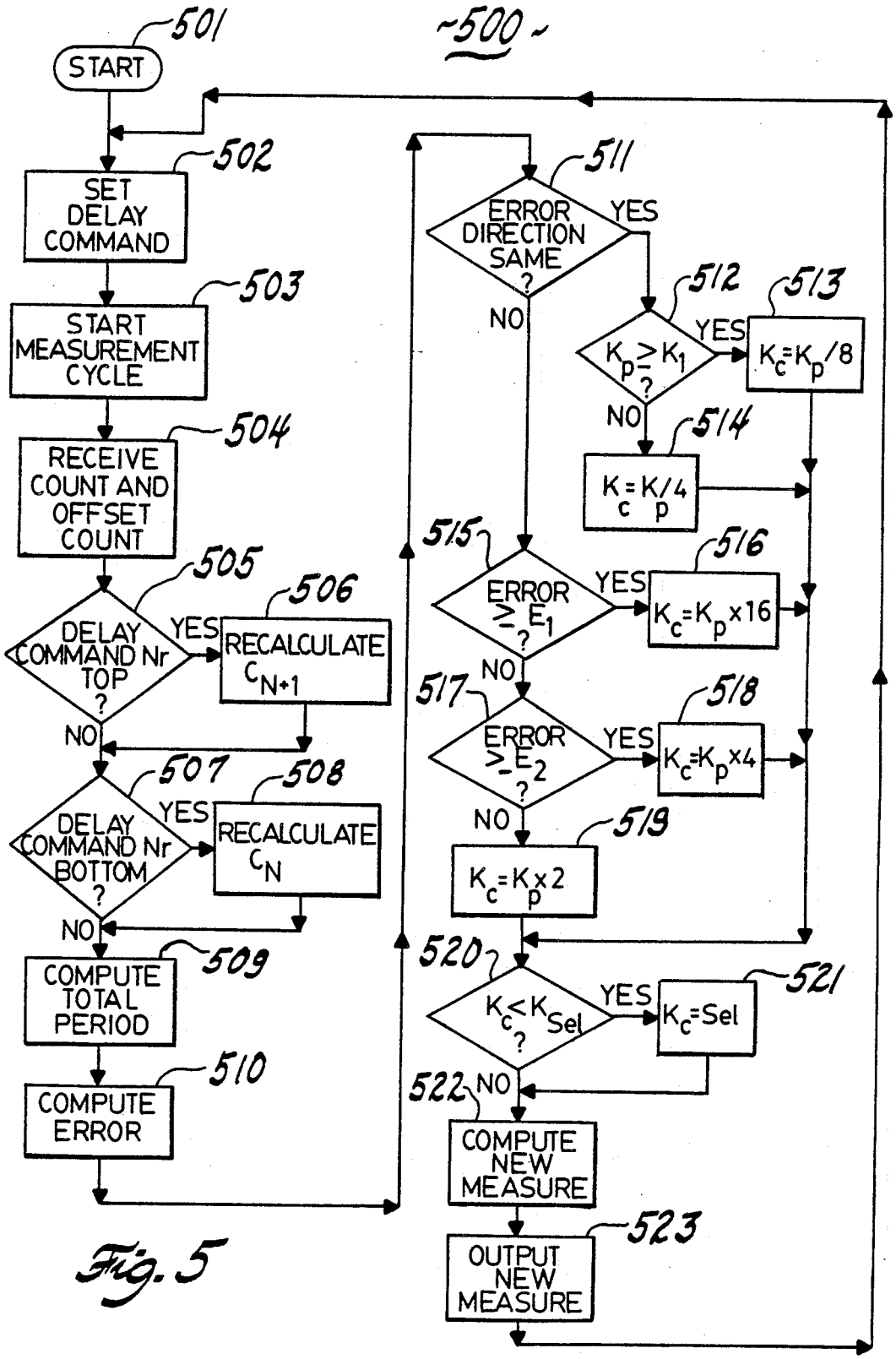
FIG. 5 is a flow chart of a program for control of the microcomputer control system illustrated in FIG. 2.

The time period measuring apparatus illustrated in FIG. 2 is controlled and operated by microcomputer control system 50 in conjunction with the program illustrated in FIG. 5. The time period measuring apparatus of FIG. 2 operates generally as follows. Microcomputer 50 issues an enable signal to counter controller 45 and simultaneously or shortly thereafter issues a start signal to start pulse synchronizer 11. Start pulse synchronizer 11 receives the clock pulses produced by high speed clock 41 and issues a start signal to counter controller 45 which triggers high speed counter 43 substantially simultaneously upon receipt. Start pulse synchronizer 11 also triggers start pulse generator 13, which triggers start pulse delay circuit 23 to produce the commanded delay as described above. Start pulse delay circuit 23 starts the time period to be measured by triggering transmitter 31. Transmitter 31 begins the operation of position detector 33. The end of the time period is detected by receiver 35 which in turn triggers analog signal conditioner 37. Analog signal conditioner 37 issues an end signal to counter controller 45, which in turn stops the counting operation of high speed counter 43. Microcomputer control system 50 thus receives the count of high speed counter 43 and the commanded delay as calibrated using delay measurement 25. Microcomputer control system 50 produces an indication of the measured time period which is coupled to user interface 60.

FIG. 5 illustrates a flow chart of the control program embodied in microcomputer control system 50. In accordance with the prior art, microcomputer control system 50 consists of a miniature programmed digital computer operating in conjunction with a stored program. The program illustrated in FIG. 5 in not intended to include the full, exact and detailed steps necessary for programming microcomputer control system 50. Instead FIG. 5 illustrates the overall general steps needed to practice the present invention. Those skilled in the art of microcomputer programming will be able to provide a detailed and complete program necessary for control of microcomputer control system 50 once the microcomputer is selected together with its instruction set. Note particularly that some processes needed in the program for microcomputer control system 50 are not illustrated in FIG. 5. These processes are the input functions required for control of the time period measurement process and the output functions for indication and/or utilization of the results of the measurements. Such processes are conventional in nature and well within the ordinary skill of one in the art. Because these processes are known in the art and do not form a part of the present invention, they are not detailed in FIG. 5.

FIG. 5 illustrates in flow chart form control program 500 employed by microcomputer control system 50. Program 500 is begun via start block 501. Program 500 first determines the delay command to transmit to variable delay control 21 (processing block 502). In accordance with the preferred embodiment of the present the fractional delay is selected corresponding to a reversed binary progression algorithm. In the preferred embodiment a 10 bit counter is incremented once each measurement cycle. The count of this counter is reversed to form the fractional delay in fractional binary form. An example of a part of this process is shown below in Table I.

TABLE I

| Binary Counter | Reversed Binary Fraction | Decimal Equivalent |
|---|---|---|
| 0000000000 | 0.0000000000 | 0.0000 |
| 0000000001 | 0.1000000000 | 0.5000 |
| 0000000010 | 0.0100000000 | 0.2500 |
| 0000000011 | 0.1100000000 | 0.7500 |
| 0000000100 | 0.0010000000 | 0.1250 |
| 0000000101 | 0.1010000000 | 0.6250 |
| 0000000110 | 0.0110000000 | 0.3750 |
| 0000000111 | 0.1110000000 | 0.8750 |
| 0000001000 | 0.0001000000 | 0.0625 |
| 0000001001 | 0.1001000000 | 0.5625 |
| 0000001010 | 0.0101000000 | 0.3125 |
| 0000001011 | 0.1101000000 | 0.8125 |
| 0000001100 | 0.0011000000 | 0.1875 |
| 0000001101 | 0.1011000000 | 0.6875 |
| 0000001110 | 0.0111000000 | 0.4375 |
| 0000001111 | 0.1111000000 | 0.9375 |

This process is continued until the binary counter overflows, whereupon the sequence is repeated. Note that the delay selected changed by $\frac{1}{2}$ every other value in the sequence, by $\frac{1}{4}$ every fourth value, by $\frac{1}{8}$ every eight value, etc. This process is believed to permit the best settling time over the entire range of fractional parts in the measured time period.

Once the particular delay has been determined according to the above sequence, the delay command is computed. Recall that the controlled delay circuit 20 of the preferred embodiment employs a 12 bit delay command which controls a five stage RC delay circuit (FIG. 4). A delay command of $C_n$ corresponds to a fractional delay of 0.000 and a delay command of $C_{n+1}$ corresponds to a fractional delay of 0.999. Microcomputer control system 50 computes the delay command DC in accordance with the following equation:

$$DC=[(C_{n+1}-C_n)\times F]+C_n$$

where F is the fractional delay determined in accordance with the reversed binary progression sequence described above. Note that this computation is a linear interpolation which assumes a linear relationship between the delay command and the delay produced. The controlled delay 20 illustrated in FIG. 4 does not necessarily produce such a linear relationship. However, it has been found that the relationship between the delay command and the delay produced by this circuit is sufficiently linear to produce acceptable results in most cases.

Program 500 next causes microcomputer control system 50 to start the measurement cycle (processing block 503). Microcomputer control system 50 needs to do several things to accomplish this. The delay command must be transmitted to avariable delay control 21. An enable signal must be transmitted to counter controller 45. Lastly, a start signal must be transmitted to start pulse synchronizer 21. This begins a measurement cycle which takes place as previously described.

Microcomputer control system 50 next receives the results of the mesurement cycle (processing block 504). These results are in the form of the count from high speed counter 43 and the measured delay from delay measurement 25. The count from high speed counter 43 is the number of whole clock cycles of high speed clock 41 from the time of the start of the measurement cycle (which occurs at the start of a clock cycle due to start pulse synchronizer 11) until the detection of the end of the time period of transducer apparatus 30. The delay measurement is the number of whole clock cycles of high speed clock 41 from the start of the messurement cycle until start pulse delay circuit 23 generates the begin signal, as counted by high speed counter 250. As indicated in processing block 504, this delay measurement is an offset to the count of high speed counter 43.

Program 500 next causes microcomputer control system 50 to check to determine if the fractional delay of the just completed measurement cycle is near 0.999 (decision block 505). This test is made by determining whether the delay command DC is within a predetermined number of counts, for example 8, of $C_{n+1}$. If this test is satisfied then it is feasible to recalculate the top end point $C_{n+1}$ and this recalculation takes place (processing block 506). This recalculation is necessary to compensate for drift in the relationship between the delay command and the actual delay produced. This recalculation is based upon the fact that a properly calibarated delay command of $C_{n+1}$ would produce a delay measurement of N 50% of the time and a delay measurement of N+1 50% of the time due to the natural variability of the delay produced for the same delay command. Rather than employ a separate recalculation cycle or wait until the reversed binary progression sequence requires a delay of 0.999, the recalculation takes place every time the delay command is near $C_{n+1}$. The range of the delay command for the recalculation should be about the same as the natural variability of the delay for the same delay command. In accordance with the preferred embodiment of the present invention, this recalibration takes place in a manner similar to the computation of the measured time period employing an adaptive averaging technique. This process will be further detailed below.

If the delay command was not near $C_{n+1}$, or if it was and the recalculation of $C_{n+1}$ is complete, the program 500 performs a similar process with regard to the bottom of the delay command range. If the delay command corresponds to a delay near 0.001 (decision block 507) then the delay command $C_n$ is recalculated (processing block 508). This process preferably takes place in a manner similar to the calibration of the delay command $C_{n+1}$ as discussed above.

Program 500 next computes the total period measured in the last measurement cycle (processing block 509). The computation takes place in accordance with the following equation:

$$T=C-(MD+F)$$

where: T is the time period measure; C is the count from high speed counter 43; MD is the measured delay from high speed counter 250; and F is the fractional delay determined and controlled in accordance with the reversed binary progression sequence. Note that this computation requires a difference because the count C is a measure of the sum of the delay (MD+F) and the time period T to be measured. The time period T represents the measurement made during the last measurement cycle.

The preferred embodiment of the present invention controls an adaptive filtering process based upon the relationship of the last time period measure T and the prior averaged time period measure $A_p$. The preferred embodiment employs an infinite impulse response (IIR) filter with a single pole and an adaptive roll off frequency. A filter response factor $K_c$, which is employed in the control of the adaptive filtering process, is adjusted according to the direction and magnitude of an error signal formed from the last time period measure T and the averaged time period measure $A_p$. This filter response factor $K_c$ is limited to the range between zero and one. In the preferred embodiment this filter response factor $K_c$ is adjusted following every measurement cycle. The filter response factor $K_c$ preferably is a 24 bit number which can vary over a very wide range. Because of this wide range of variation, the filter response factor $K_c$ can be changed by a small amount every cycle without greatly changing the filter response. It is also feasible to include a dead band of small errors which do not cause a change in the filter response factor $K_c$. In this embodiment the filter response factor $K_c$ can be adjusted to be sufficiently great to permit rapid response. Those skilled in the art would recognize that other adaptive filter algorithms could be used in this system.

Program 500 computes the error for the last measurement based upon the difference between the last time period measure T and the averaged time period measure $A_p$ (processing block 510). The average time period measure $A_p$ is formed in a manner that will be explained below. Formation of this error includes setting an error direction flag to indicate the direction of difference between the last time period measure T and the averaged time period measure $A_p$.

Program 500 next checks to determine if the last measured error was in the same direction as the immediate prior error (decision block 511). This process includes a comparison of the flag indicating the direction of the error of the last measurement and another flag indicating the direction of the immediate prior error. In the event that the error directions are different, the filter response factor $K_c$ is reduced. Program 500 tests to determine if the prior filter response factor $K_p$ was greater than a predetermined filter response factor $K_1$ (decision block 512). If the prior filter response factor $K_p$ was greater than or equal to the predetermined filter response factor $K_1$, then the filter response factor $K_c$ is set as $K_p$ divided by eight (processing block 513). Otherwise, the filter response factor $K_c$ is set as $K_p$ divided by four (processing block 514).

This process insures that the filter response factor $K_c$ is decreased, thereby decreasing the filter roll off frequency each time the error changes directions. In the case in which the time period to be measured is stable, the natural errors of the measurement system will result in generally alternating error directions resulting in greater filtering, until the noise limit of the system is reached.

The filter response factor $K_c$ is increased when the current error is in the same direction as the prior error. This would occur if the averaged time period measure $A_p$ has not stabilized or if the time period to be measured is changing. Program 500 first tests to determine if the error is greater than or equal to a first predetermined error $E_1$ (decision block 515). If this is the case, then the current filter response factor $K_c$ is set as $K_p$ multiplied by sixteen (processing block 516). If this is not the case, program 500 tests to determine if the error is greater than or equal to a smaller second predetermined error $E_2$ (decision block 517). If this is the case, then the current filter response factor $K_c$ is set as $K_p$ multiplied by four (processing block 518). If this is not the case, that is if the current error is less than the smaller second predetermined error $E_2$, then the current filter response factor $K_c$ is set as $K_p$ multiplied by two (processing block 519). A greater filter response factor $K_c$ corresponds to a faster responding system. Thus if the error direction is the same as the previous error direction, the greater the error the faster the needed response time. Conversely, when the error is smaller, the filter response factor $K_c$ need not be increased by as much.

A final adjustment of the filter response factor $K_c$ takes place in accordance with a user specified response time. Microcomputer control system 50 preferably includes via user interface 60 some manner permitting the user to specify the maximum response time of the measurement system. This maximum response time implies a minimum filter response factor $K_{Sel}$. Program 500 tests to determine if the filter response factor $K_c$ computed in accordance with the technique described above is less than the minimum filter response factor $K_{Sel}$ (decision block 520). If this is the case, then the filter response factor $K_c$ is replaced with the minimum filter response factor $K_{Sel}$ (processing block 521). Otherwise the filter response factor $K_c$ is unchanged.

Program 500 next computes the new measure of the time period. As stated above, this takes place in accordance with an infinite impulse filter with a single pole whose roll off frequency is changeable based upon the error. The current time period measure $A_c$ is computed as follows:

$$A_c=A_p\times(1-K_c)+(T\times K_c)$$

where: $A_c$ is the current time period measure; $A_p$ is the prior time period measure; $K_c$ is the adaptive filter response factor; and T is the last time period measure.

Once the new time period measure $A_c$ has been computed it is output for utilization via user interface 60 (processing block 523). Program 500 then repeats the process by returning to processing block 502.

As previously discussed, the filter response factor $K_c$ determines the response time of the measurement system. A filter response factor $K_c$ near one results in a current time period measure $A_c$ which substantially tracks the last time period measure T. A filter response factor $K_c$ near zero results in a current time period measure $A_c$ which is the average of many prior time period measures T.

This adaptive filtering technique has been shown to produce good dynamic response. This technique provides fast response when needed, while producing little overshoot due to the adaption of the filter response factor. In the preferred embodiment in which the measurement system measures a position via a magnetostrictive position detector, this technique enables measurement resolution in the range of $10^{-8}$ of an inch using a 55 MHz clock rate. The natural variation of the measurement process results in position errors in the range of 5 to 10 counts of the 55 MHz clock. It has been found that an ordinary average of the raw count does not achieve the resolution provided by the changing fractional delay and the adaptive averaging of the present invention. The raw count typically oscillates between two numbers several counts distance with periodic shifts to another pair of numbers. The reason for this behavior is not completely understood but is believed related to standing waves induced in magnetostrictive wire 333 despite the existence of damping terminations. Thus a simple average of the raw count does not settle to a reliable average resolution in the manner of the present invention.

Figure 6:
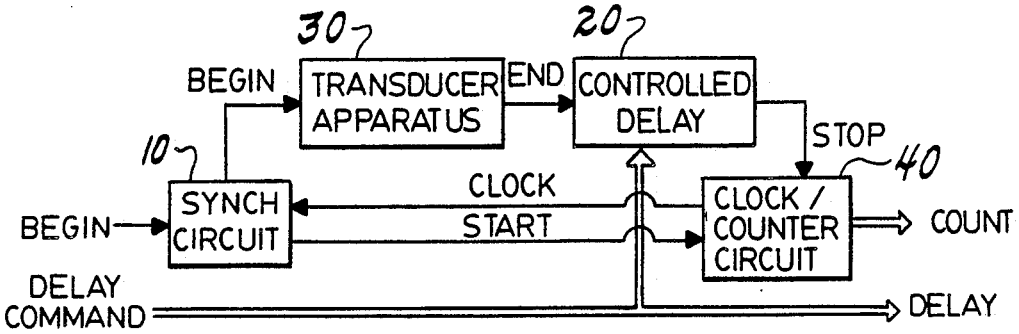
FIG. 6 is a block diagram of the variable time period apparatus in accordance with a first alternative embodiment of the present invention.
Figure 7:
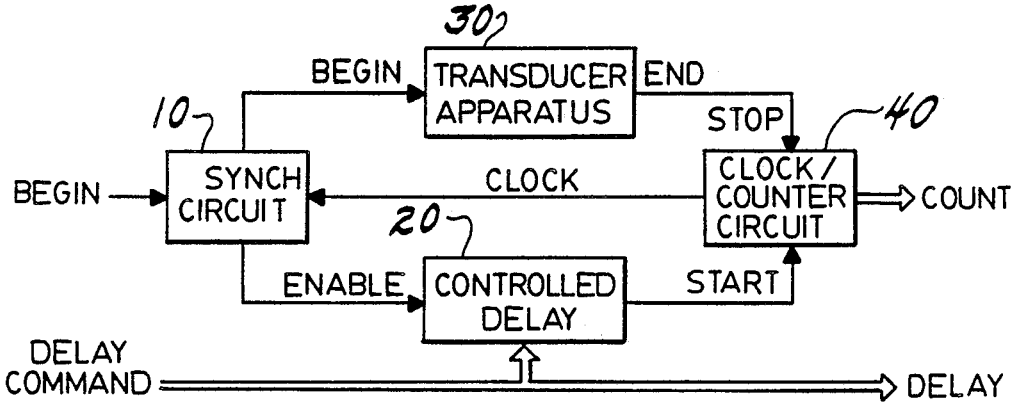
FIG. 7 is a block diagram of the variable time period apparatus in accordance with a second alternative embodiment of the present invention.
Figure 8:
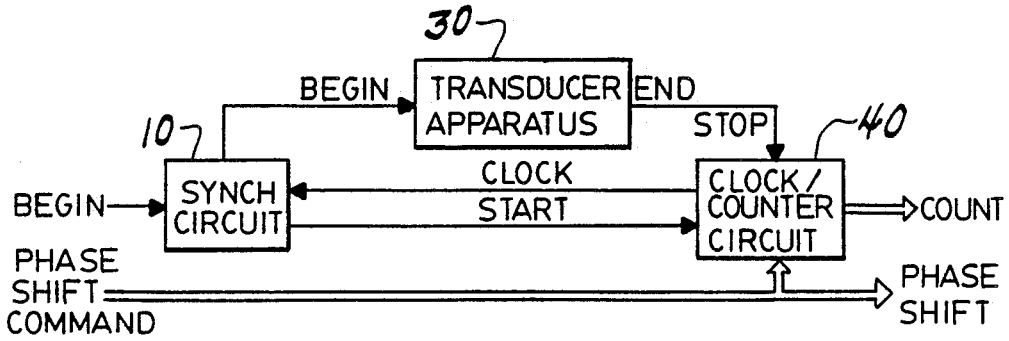
FIG. 8 is a block diagram of the variable time period apparatus in accordance with a third alternative embodiment of the present invention.

FIGS. 6, 7 and 8 illustrate alternative constructions of the present invention. In FIG. 6 the controlled delay circuit 20 is placed after the transducer apparatus 30 and before the clock/counter circuit 40. In this alternative construction, synchronization circuit 10 simultaneously begins the time period of transducer apparatus 30 and starts the counting operation of clock/counter circuit 40. The detection of the end of the time period of transducer apparatus 30 starts the delay period of controlled delay circuit 20. The time period measurement process is controlled in the same manner as in the case of the construction of FIG. 1. The alternative construction of FIG. 6 and produces the same outputs and the construction of FIG. 1, namely the count of clock/counter circuit 40 and the delay provided by controlled delay circuit 20. These quantities are employed in the same manner as previously disclosed. Thus computation of the time period T takes place in accordance with the following equation:

$$T=C-D$$

where: T is the time period measure; and D is the delay produced by controlled delay 20. This delay D in the preferred embodiment was the sum of the measured delay MD and the fractional part F. Note that the alternative construction of FIG. 6 employs the cascaded delays of controlled delay circuit 20 and transducer apparatus 30 in the opposite order than the preferred embodiment of FIG. 1. In other respects the alternative construction of FIG. 6 operates identically as that illustrated in FIG. 1.

The alternative construction illustrated in FIG. 7 differs in the manner of logical use of controlled delay 20. In the alternative embodiment of FIG. 7, controlled delay 20 is placed between synchronization circuit 10 and clock/counter circuit 40, delaying the start of the counting operation. In this case the resulting data must be employed differently than previously discussed. The sum of the delay of controlled delay 20 and the count of clock/counter circuit 40 corresponds to the time period of transducer apparatus 30. Thus the computation of time period T takes place in accordance with the following equation:

$$T=C+D$$

where: T is the time period measure; C is the count from clock/counter 40; and D is the delay produced by controlled delay 20.

FIG. 8 illustrates a third alternative embodiment of the present invention. In this third alternative embodiment the fractional part F is embodied by a phase shift command. In one form of this technique, clock/counter circuit 40 is begun at a phase other than the start of the cycle. This beginning phase is controlled to produce the fractional part F in accordance with the principles of the invention outlined above. In another form of this technique, the clock within clock/counter circuit 40 is skewed during the counting operation to advance or retard the count by the fractional part. In either case the time measurement is formed in accordance with the principles of the invention described above.

The embodiment illustrated in FIG. 1 is preferred to the alternative embodiments illustrated in FIGS. 6, 7 and 8. This embodiment is preferred because it is feasible to use the controlled delay 20 illustrated in FIG. 4. The practical problems of providing a consistent and stable delay are more difficult when employing the alternative embodiments.

I claim:

1. An adaptive time period measuring apparatus for measuring a time period provided by a transducer apparatus corresponding to a physical quantity to be measured, said adaptive time period measuring apparatus comprising:

a clock/counter circuit for counting the number of repetitive clock pulses produced at a predetermined fixed clock cycle rate during a counting interval between the receipt of a start count signal and the receipt of a stop count signal;

a start device connected to said clock/counter circuit for transmitting a start count signal to said clock/counter circuit when triggered;

a stop device connected to the transducer apparatus and said clock/counter circuit for transmitting a stop count signal to said clock/counter circuit upon termination of the time period of the transducer apparatus;

a variable time delay device connected to at least one of the transducer apparatus and said clock/counter circuit having a delay time variable over an interval corresponding to at least one clock cycle, for delaying one of the starting of said counting interval of said clock/counter circuit or the stopping of said counting interval of said clock/counter circuit relative to the time period of the transducer apparatus; and an adaptive control device connected to said clock-/counter circuit, said start device and said variable time delay device for producing a measure of the time period provided by the transducer apparatus by repeatedly triggering said start device, controlling the delay time of said variable time delay device for each triggering of said start device in accordance with a predetermined sequence of delay times over a range of one clock cycle, forming a current time period measure equal to the algebraic sum of said count of said clock/counter circuit and said delay time of said variable time delay device for each triggering of said start device, and producing said measure of the time period provided by the transducer apparatus corresponding to a filtered quantity of said current time period measures for a number of triggerings of said start device.

2. The adaptive time period measuring apparatus as claimed in claim 1, wherein:

said variable time delay device consists of at least one RC delay circuit including a fixed resistor and a controllable capacitor.

3. The adaptive time period measuring apparatus as claimed in claim 2, wherein:

said controllable capacitor of each RC delay circuit consists of a varactor diode.

4. The adaptive time period measuring apparatus as claimed in claim 3, wherein:

said variable time delay device further includes a digital to analog converter receiving a multibit delay command and connected to said varactor diode of each RC delay circuit for supplying a voltage corresponding to said multibit delay command to said varactor diode of each RC delay circuit.

5. The adaptive time period measuring apparatus as claimed in claim 1, further comprising:

said adaptive control device controls said predetermined sequence of delay times of said variable time delay device for each triggering of said start device to provide substantially equal occurrence of all fractions of one clock cycle delay time within said range of one clock cycle.

6. The adaptive time period measuring apparatus as claimed in claim 5, wherein:

said adaptive control device controls said predetermined sequence of delay times of said variable time delay device for each triggering of said start device in accordance with a reversed binary progression of delay times.

7. The adaptive time period measuring apparatus as claimed in claim 1, wherein:

said adaptive control device produces said measure of the time period provided by the transducer apparatus corresponding to the following equation $$A_c = A_p \times (1 - K_c) + (T \times K_c)$$

where $A_c$ is said measure of the time period; $A_p$ is the immediate prior measure of the time period measure; $K_c$ is a filter response factor; and T is the last formed current time period measure.

8. The adaptive time period measuring apparatus as claimed in claim 7, wherein:

said adaptive control device produces said measure of the time period provided by the transducer apparatus by forming an error signal from the measure of the time period $A_p$ and the current time period measure T for each triggering of said start device, generally decreasing the filter response factor $K_c$ if the last formed error signal has the opposite sense as the prior formed error signal, and generally increasing the filter response factor $K_c$ if the last formed error signal has the same sense as the prior formed error signal.

9. The adaptive time period measuring apparatus as claimed in claim 1, further comprising:

a delay measuring device connected to said variable time delay device for measuring said delay time of said variable time delay device; and said adaptive control device is further connected to delay measuring device for forming said algebraic sum of said count of said clock/counter circuit and said delay time of said variable time delay device for each triggering of said start device based upon said delay time measured by said delay measuring device.

10. The adaptive time period measuring apparatus as claimed in claim 1, wherein:

said start device is further connected to said clock for transmitting said start count signal to said clock-/counter circuit at the same phase of said regular clock cycle whenever triggered.

11. The adaptive time period measuring apparatus as claimed in claim 1, wherein:

said variable time delay device is connected to the transducer apparatus and said start device for starting the time period of the transducer apparatus said delay time following said start count signal; and said adaptive control device forms said algebraic sum by forming the difference between said count of said clock/counter circuit and said delay time of said variable time delay for each triggering of said start device.

12. The adaptive time period measuring apparatus as claimed in claim 1, wherein:

said variable time delay device is connected to the transducer apparatus and said stop device for triggering said stop device said delay time following the end of the time period of the transducer apparatus for measuring the physical quantity; and said adaptive control device forms said algebraic sum by forming the sum of said count of said clock-/counter circuit and said delay time of said variable time delay for each triggering of said start device.

13. The adaptive time period measuring apparatus as claimed in claim 1, wherein:

said variable time delay device is connected to the transducer apparatus and said start device for triggering said start device said delay time following starting the time period of the transducer apparatus; and said adaptive control device forms said algebraic sum by forming the sum of said count of said clock-/counter circuit and said delay time of said variable time delay for each triggering of said variable time delay device.

14. The adaptive time period measuring apparatus as claimed in claim 1, wherein:

said variable time delay device is connected to said clock/counter circuit and said start device for triggering said start device on a phase of the clock cycle of said clock/counter circuit corresponding to said delay time when triggered; and said adaptive control device forms said algebraic sum by forming the sum of said count of said clock-/counter circuit and said delay time for each triggering of said start device.

15. The adaptive time period measuring apparatus as claimed in claim 1, wherein:

said variable time delay device is connected to said clock/counter circuit for producing a phase shift in said clock pulses corresponding to said delay time during said counting interval; and said adaptive control device forms the algebraic sum of said count of said clock/counter circuit and said phase shift for each triggering of said start device.

16. An adaptive time period measuring apparatus for measuring a time period provided by a transducer apparatus corresponding to a physical quantity to be measured, said adaptive time period measuring apparatus comprising:

a clock circuit for generating repetitive clock pulses at a predetermined regular clock cycle rate;

a counter connected to said clock circuit for counting the number of clock pulses received during a counting interval between the receipt of a start count signal and the receipt of a stop count signal;

a start device connected to said clock circuit for receiving said repetitive clock pulses and to said counter for transmitting a start count signal to said counter at the same phase of said regular clock cycle when triggered;

a stop device connected to the transducer apparatus and said counter for transmitting a stop count signal to said counter upon termination of the time period of the transducer apparatus;

a variable time delay device connected to the transducer apparatus and said start device, for producing a delay time variable over an interval corresponding to at least one clock cycle for delaying the starting the time period of the transducer apparatus after starting said counting interval of said counter, said variable time delay device including at least one RC delay circuit having a fixed resistor, a varactor diode, and a variable bias source connected to said varactor diode of each RC delay circuit for control of the effective capacitance of said varactor diode of each RC delay circuit thereby controlling said delay time; and an adaptive control device connected to said counter, said start device and said variable time delay device for producing a measure of the time period provided by the transducer apparatus by repeatedly triggering said start device, controlling the delay time of said variable time delay device for each triggering of said start device in accordance with a predetermined sequence of delay times over a range of one clock cycle, said predetermined sequence of delay times providing substantially equal occurrence of all fractions of one clock cycle delay time within said range of one clock cycle, forming a current time period measure T equal to the difference between said count of said counter and said delay time of said variable time delay device for each triggering of said start device, forming an error signal from the immediate prior measure of the time period $A_p$ and the current time period measure T for each triggering of said start device, generally decreasing a filter response factor $K_c$ if the last formed error signal has the opposite sense as the prior formed error signal, generally increasing said filter response factor $K_c$ if the last formed error signal has the same sense as the prior formed error signal, and producing said measure of the time period provided by the transducer apparatus corresponding to the following equation $$A_c = A_p \times (1 - K_c) + (T \times K_c)$$

where: $A_c$ is said measure of the time period; $A_p$ is the immediate prior measure of the time period measure; $K_c$ is a filter response factor; and T is the last formed current time period measure.

17. The adaptive time period measuring apparatus as claimed in claim 16, wherein:

said adaptive control device controls said predetermined sequence of delay times of said variable time delay device for each triggering of said start device in accordance with a reversed binary progression of delay times.

18. The adaptive time period measuring apparatus as claimed in claim 16, wherein:

said variable bias source of said variable time delay device comprises a digital to analog converter receiving a multibit digital delay command for producing a bias voltage corresponding to said multibit digital delay command.

19. The adaptive time period measuring apparatus as claimed in claim 18, further comprising:

a secondary counter connected to said clock circuit and said variable time delay device for counting the number of clock pulses received during said delay time of said variable time delay device;

said variable time delay device is controllable via said multibit digital delay command to produce a delay variable at least over the range of N to N+1 clock cycles, said adaptive control device is further connected to said secondary counter and includes means for determining a first multibit digital delay command $C_{N+1}$ which would produce a count within said secondary counter of N 50% of the time and a count within said secondary counter of N+1 50% of the time, determining a second multibit digital delay command $C_N$ which would produce a count within said secondary counter of N - 1 50% of the time and a count within said secondary counter of N 50% of the time, generating said multibit digital delay command corresponding to the following equation:

$$DC = [(C_{N+1} - C_N) \times F] + C_N$$

where DC is said multibit digital delay command, and F is the fractional delay to be formed.

20. An adaptive method for measuring a time period provided by a transducer apparatus corresponding to a physical quantity to be measured, said adaptive method comprising the steps of:

repeatedly triggering the transducer apparatus to produce the time period;

counting repetitive clock pulses having a predetermined regular clock cycle during a counting interval between a time related to the triggering of the transducer apparatus and a time related to the termination of the time period of the transducer apparatus;

producing a delay time in one of the time between triggering of the transducer apparatus and starting the counting interval and time between the termination of the time period of the transducer apparatus and ending the counting interval for each triggering of said transducer apparatus in accordance with a predetermined sequence of delay times over a range of one clock cycle, said predetermined sequence of delay times providing substantially equal occurrence of all fractions of one clock cycle delay time within said range of one clock cycle, forming a current time period measure equal to the algebraic sum of the count of said clock pulses during the counting interval and said delay time for each triggering of said transducer apparatus, and producing a measure of the time period provided by the transducer apparatus corresponding to an adaptively filtered quantity of said current time period measures for a number of triggerings of said transducer apparatus.

* * * * *

UNITED STATES PATENT AND TRADEMARK OFFICE

CERTIFICATE OF CORRECTION

PATENT NO. : 4,995,019

DATED : February 19, 1991

INVENTOR(S) : Begin

It is certified that error appears in the above-identified patent and that said Letters Patent is hereby corrected as shown below:

Column 1, line 57, "quantitY" should be --quantity--;

Column 3, line 47, "and" should be --or--;

Column 5, line 65, "applied." should be --applied--;

Column 6, line 32, "wiree" should be --wire--;

Column 6, line 41, "wiree" should be --wire--;

Column 7, line 16, "invetor" should be --invertor--;

Column 7, line 25, "dalay" should be --delay--;

Column 7, line 34, "vbolts" should be --volts--;

Column 7, line 47, "it" should be --It--;

Column 7, line 60, delete "to have";

Column 8, line 23, "dely" should be --delay--;

Column 8, line 31, "$C_n$" should be --$C_{n+1}$--;

Column 8, line 68, after "measurement" insert --circuit--;

UNITED STATES PATENT AND TRADEMARK OFFICE

CERTIFICATE OF CORRECTION

PATENT NO. : 4,995,019

DATED : February 19, 1991

INVENTOR(S) : Begin

It is certified that error appears in the above-identified patent and that said Letters Patent is hereby corrected as shown below:

Column 10, line 4, "0.000" should be --0.001--;

Column 10, line 26, "avariable" should be --variable--.

Signed and Sealed this

Twenty-fifth Day of August, 1992

*Attest:*

DOUGLAS B. COMER

*Attesting Officer*

*Acting Commissioner of Patents and Trademarks*